United States Patent [19]

Sung

[11] Patent Number: 4,689,051

[45] Date of Patent: Aug. 25, 1987

[54] STORAGE-STABILIZING ADDITIVES FOR MIDDLE DISTILLATE FUELS

[75] Inventor: Rodney L. Sung, Fishkill, N.Y.

[73] Assignee: Texaco Inc., White Plains, N.Y.

[21] Appl. No.: 867,668

[22] Filed: May 28, 1986

[51] Int. Cl.[4] ..... C10L 1/22

[52] U.S. Cl. ..... 44/72; 44/57; 44/63

[58] Field of Search ..... 44/57, 63, 72

[56] References Cited

U.S. PATENT DOCUMENTS

| | | | |
|---|---|---|---|
| 4,179,551 | 12/1979 | Jones | 528/322 |
| 4,326,987 | 4/1982 | Hendricks et al. | 44/63 |
| 4,348,210 | 9/1982 | Sung | 44/56 |
| 4,477,261 | 10/1984 | Sung | 44/71 |
| 4,505,717 | 3/1985 | Sung | 44/72 |
| 4,536,189 | 8/1985 | Sung | 44/63 |
| 4,581,040 | 4/1986 | Sung et al. | 44/72 |

*Primary Examiner*—William R. Dixon, Jr.
*Assistant Examiner*—Margaret B. Medley
*Attorney, Agent, or Firm*—Robert A. Kulason; James J. O'Loughlin; Vincent A. Mallare

[57] ABSTRACT

Diesel oil of improved storage stability contains a condensate of an alkyl polyoxyethylene polyoxypropylene amine, maleic anhydride and an N-alkyl alkylene diamine.

15 Claims, No Drawings

STORAGE-STABILIZING ADDITIVES FOR MIDDLE DISTILLATE FUELS

FIELD OF THE INVENTION

This invention relates to middle distillate fuel oils. More particularly it relates to middle distillate fuel oils characterized by improved storage stability.

BACKGROUND OF THE INVENTION

As is well known to those skilled in the art, middle distillate fuels typified by diesel fuel, home heating oil, etc are characterized by undesirable storage stability when stored in the presence of air even at room temperature. Over the course of time, these fuels become cloudy and produce sediment which deposits on the surfaces with which the fuel comes into contact. It particularly deposits on and clogs small openings such as those in fuel filters and strainers, in diesel engine injection nozzles, etc. It is an object of this invention to provide a middle distillate fuel oil characterized by improved storage stability. Other objects will be apparent to those skilled in the art.

INFORMATION DISCLOSURE STATEMENT

U.S. Pat. No. 4,419,105 discloses the use of the reaction product of maleic anhydride and certain amines or diamines as corrosion inhibitors in alcohols.

U.S. Pat. No. 4,321,062 discloses the use of the reaction product of maleic anhydride, certain phenols, and certain alkyl-alkylene diamines as a corrosion inhibitor and carburetor detergent additive in motor fuels.

U.S. Pat. No. 4,290,778 discloses the use of the reaction product of a hydrocarbyl alkoxyalkylene diamine and maleic anhydride as a corrosion inhibitor and carburetor detergent additive in motor fuels.

U.S. Pat. No. 4,207,079 discloses the use of the reaction product of maleic anhydride and certain alkyl-alkylene diamines as a corrosion inhibitor and a carburetor detergent additive in motor fuels.

U.S. Pat. No. 4,144,034 discloses the use of the reaction product of a polyether amine and maleic anhydride as a carburetor detergent and corrosion inhibitor in motor fuels.

U.S. Pat. No. 3,773,479 discloses the use of the reaction product of maleic anhydride and alkyl alkylene amines as a carburetor detergent, corrosion inhibitor and anti-icing additive in motor fuels.

Co-assigned U.S. Pat. No. 4,207,079 discloses a motor fuel composition containing, as an additive, a hydrocarbon-substituted primary amino alkylene-substituted asparagine.

SUMMARY OF THE INVENTION

In accordance with certain of its aspects, this invention is directed to a middle distillate fuel oil composition characterized by improved storage stability. This fuel oil composition comprises a major portion of a middle distillate fuel oil and a minor effective portion of an additive prepared by reacting (i) a hydrocarbon-substituted mono primary amine or a hydrocarbon-substituted mono primary etheramine, (ii) a dibasic acid anhydride, and (iii) an N-alkyl alkylene diamine.

DESCRIPTION OF THE INVENTION

The charge compositions which may be employed in practice of the process of this invention according to certain of its aspects may include primary amines or primary ether amines. The amines may typically be characterized by the formula $$R—NH_2$$

where R is a monovalent hydrocarbon radical having from about 6 to about 20 carbon atoms or a hydrocarbon-substituted aminoalkylene radical in which the hydrocarbon group has from about 6 to about 20 carbon atoms and in which the divalent alkylene group has from about 2 to about 3 carbon atoms and the hydrocarbon-substituted mono-primary ether amine being represented by the formula:

$$R'\text{+}O(CH_2)_z\text{+}_x\left[OCH_2—\underset{\underset{CH_3}{|}}{CH}\right]_y NH_2$$

wherein R' is a ($C_1$–$C_{12}$) hydrocarbon radical, z is an integer of about 2 to about 5, x is an integer of about 0 to about 19 and y is an integer of about 4 to about 10.

The molecular weight ($\overline{M}n$) of the primary ether amines may range from about 200 to about 2000. Examples of the primary ether amine, which may be employed herein, include those listed below in Table I. These primary ether amines (i.e., alkyl polyoxyethylene polyoxypropylene amines) are commercially available under the tradename of JEFFAMINE-M which are manufactured and marketed by Texaco Chemical Company of Houston, Tex.

TABLE I

| | |
|---|---|
| JEFFAMINE M-300: | alkyl ($C_{10}C_{12}$) dioxypropylene amine<br>$(C_{10}C_{12})—(OCH_2—\underset{\underset{CH_3}{\vert}}{CH})_2—NH_2$ |
| JEFFAMINE: M-360: | n-butyl tetraoxyethylene dioxypropylene amine<br>$nC_4H_9\text{+}OC_2H_4\text{+}_4\left[OCH_2—\overset{\overset{CH_3}{\vert}}{CH}\right]_2 NH_2$ |
| JEFFAMINE M-600: | methyl oxyethylene nonyloxypropylene amine<br>$CH_3\text{+}OC_2H_4]\left[OCH_2—\underset{\underset{CH_3}{\vert}}{CH}\right]_9 NH_2$ |
| JEFFAMINE M-1000: | methyl nonyldecyl oxyethylene dioxypropylene amine<br>$CH_3\text{+}OCH_2CH_2\text{+}_{19}\left[O—CH_2\underset{\underset{CH_3}{\vert}}{CH}\right]_2 NH_2$ |

The N-alkyl alkylene diamine reactants are preferably diamines, which bear at least one primary amine-$NH_2$ group and at least one substituted primary amine group. The latter may be di-substituted but, more preferably, it is mono-substituted. The hydrocarbon nucleous of the amine may be aliphatic or aromatic, including alkyl, alkaryl, aralkyl, aryl, or cyclalkyl in nature. The preferred amine has the formula $$R'—NH—R''—NH_2$$

where R′ is a ($C_{12}$–$C_{18}$) hydrocarbon group and R″ is a ($C_3$–$C_{12}$) hydrocarbon group. In the preferred amines, i.e., monosubstituted primary amines, R′ may be an alkyl, alkaryl, aralky., aryl, or cycloalkyl hydrocarbon group and R″ may be an alkylene, aralkylene, alkarylene, arylene, or cycloalkylene hydrocarbon group.

Illustrative of the preferred N-primary alkylalkylene diamines may include those listed below in Table II.

TABLE II

A. The Duomeen O brand of N-oleyl-1,3-propane diamine.
B. The Duomeen S brand of N-stearyl-1,3-propane diamine.
C. The Duomeen T brand of N-tallow-1,3-propane diamine.
D. The Duomeen C brand of N-coco-1,3-propane diamine.

The most preferred diamine, R′—NH—R″—$NH_2$, is that where the R″ group is propylene, —$CH_2CH_2CH_2$— and the R′ group is a ($C_{12}$–$C_{18}$) n-alkyl group.

The dibasic acid anhydrides, of the present invention, may be represented by the formula

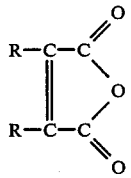

where R is H, $CH_3$— or $C_2H_5$—.

Accordingly, the dibasic acid anhydrides may include the following:

maleic anhydride
alpha-methyl maleic anhydride
alpha, beta-dimethyl maleic anhydride The preferred dibasic acid anhydride is maleic anhydride.

The reaction product is prepared by first reacting maleic anhydride with the prescribed primary either amine. The reaction 1–2 mole, say 1 mole of maleic anhydride with 1–2 moles, say 1 mole of maleic anhydride with 1–2 moles, say 1.0 mole of the primary ether amine is preferably carried out in the presence of a solvent. A preferred solvent is one which will distill with water azeotropically. Suitable solvents include hydrocarbons boiling in the gasoline boiling range of about 30° C. to about 200° C. Generally, this will include saturated and unsaturated hydrocarbons having from about 5 to about 10 carbon atoms. Specific suitable hydrocarbon solvents include hexane, cyclohexane, benzene, toluene, and mixtures thereof. Xylene is the preferred solvent. The solvent can be present in an amount of up to about 90 percent by weight of the total reaction mixture. Then, the mixture is cooled to about 60° C. where 1 to 2 moles of a n-alkyl alkylene diamine is added. The mixture with the N-alkyl alkylene diamine is continued to be heated for 2 hours at 100° C. After vacuum stripping the solvent from the mixture, the resulting product is the instant condensate product.

In a preferred method for preparing the reaction product, the 1 mole maleic anhydride and 1 mole of JEFFAMINE M-600 are combined with the solvent xylene and reacted at a temperature of about 100° C. The reaction mixture is maintained at this temperature for approximately 2 hours. The mixture is then cooled to about 60° C., whereupon 1–2 moles, say 1 mole of Duomeen-OL is added. The new mixture is then reacted at about 100° C. for approximately 2 hours. The reaction product can then be separated from the solvent using conventional means, or left in admixture with some or all of the solvent to facilitate addition of the reaction product to gasoline or another motor fuel composition. The final reaction product structure (as evidenced by elemental analysis, IR analysis and NMR analysis) may be represented by the following flow process diagram.

In the process illustrated below, initially, maleic anhydride (A) is reacted with primary ether amine (B) to form maleamic acid (C). Then the maleamic acid (C) is reacted with a n-alkyl alkylene diamine (D) to form the condensate product (E) of methyl oxyethylene polyoxypropyleneamine maleic anhydride, and polyalkylene polyamine. Accordingly, the condensate product (E) is recovered.

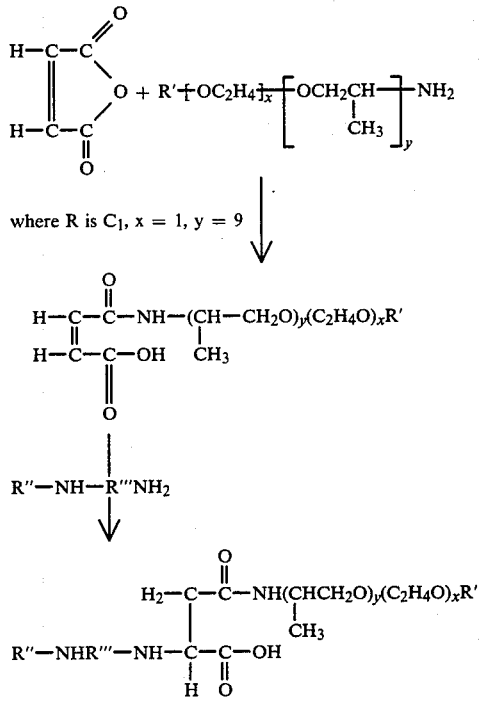

where x is 1 and R′ is ($C_1$), y is a numeral of about 9 and R″ is a ($C_{12}$–$C_{18}$) hydrocarbon group and R‴ is a ($C_3$–$C_{12}$) hydrocarbon group.

The advantages and features of the present invention will be more apparent from the Examples below. The following examples illustrate the preferred method of preparing the reaction product of the instant invention. It will be understood that the following examples are merely illustrative, and are not meant to limit the invention in any way. In the example, all parts are parts by weight unless otherwise specified.

EXAMPLE I

A reaction product was formed by reacting 49 parts of maleic anhydride. 429 parts of xylene and 2874 parts of the Jeffamine M-600 at 100° C. for 2 hours. Approximate molecular weight 5.9 having the general formula:

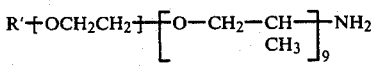

where R' has an approximate value of 1. The mixture was thereafter cooled to about 60° C. and 160.5 parts of Duomeen-O were added. The new mixture was then reacted at about 100° C. for 2 hours to produce the final reaction product. The reaction product was filtered and stripped of the remaining solvent under a vacuum. The final reaction product structure (as evidenced by elemental analysis, IR analysis and NMR analysis) was as previously described.

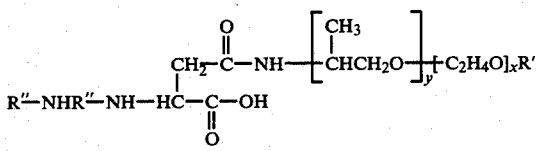

where R' has a value from about 1 depending upon the particular JEFFAMINE M reactant employed and x has a value from about 0 to about 19, y has a value of about 4 to about 10 and R''' is (—$CH_2CH_2CH_2$—) and R'' is a ($C_{12}$–$C_{18}$) hydrocarbon.

The potential deposit controlling agents are provided in the examples below:

In Examples II and III the same procedure is used as that in Example I except for the amount of JEFFAMINE M-300 and JEFFAMINE M-1000. Thus, for each example, the amount of polyether amine and N-alkyl alkylene diamine are provided below with the structure of the condensate product.

EXAMPLE II

Amount of Jeffamine M-300: 144.8 parts
Amount of Duomeen-T: 187 parts.

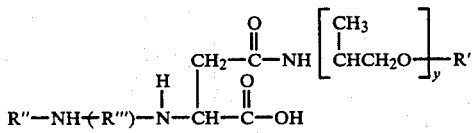

where R' is ($C_{10}$–$C_{12}$), x is 0, y is 2, R'' is a ($C_{12}C_{18}$) hydrocarbon group and R''' is (—$CH_2CH_2CH_2$—).

EXAMPLE III

Amount of Jeffamine M-1000: 615 parts
Amount of Duomeen-T: 187 parts.

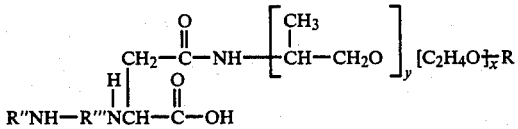

where R' is ($C_1$), y is 2, x is 19, R'' is a ($C_{12}$–$C_{18}$) hydrocarbon group and R''' is (—$CH_2CH_2CH_2$—).

The middle distillate fuel oil compositions to which these products may be added include hydrocarbon liquids having an ibp of 300° F.–430° F., say about 400° F., as 50% bp of 430° F.–610° F., say 597° F. and an API gravity of 30–60, say 352. They may be commonly identified as kerosene, Avjet fuel, diesel oil, fuel oil, home heating oil, etc. They include products having the noted boiling points recovered as cut from oils obtained by the hydrogenation of heavy oils or of solid carbonaceous fuels such as coal typified by the liquid identified as diesel fuel cut from H-Oil.

It is a feature of this invention that improved storage stability may be imparted to middle distillate fuel oils by addition thereto of an effective amount of the above-noted additive. An effective amount may be 250–0.25 PTB, preferably 100–10 PTB, say 25 PTB (PTB stands for pounds per thousand barrels).

Middle distillate fuel composition containing Examples 1 through 3 were tested for stability in the Potential Deposit Test. The Potential Deposit Test procedure requires filtering of 100 ml of the test fuel into a test tube through a 15 centimeter Number 1 Whatman filter paper. An air delivery tube was inserted in the test tube through a cork that has been slotted on the sides to allow the air to escape. The delivery tube was adjusted so that its tip, which has been cut at a 45° angle, just touches the bottom of the test tube. The test tube was placed in an oil bath of 270±±°F. and preheated. The delivery tube was connected to a flow meter and the air was bubbled through the fuel for 2 hours at a rate of 3 liters per hour. To remove acidic materials from the air the air was first bubbled through 20 percent caustic solution, then distilled and then bubbled through distilled water prior to passing it through the test fuel. The test tube was removed from the oil bath, the oil was wiped from the outside of the tube and the tube was placed in a constant temperature bath maintained at 77°±0.5° F. The test fuel sample was then filtered using suction at pressure of 75 to 85 mm Hg below atmospheric pressure through a 4.25 cm. No. 1 Whatman filter paper clamped between two halves of Millipore filter holder. The fuel oil from the funnel and filter paper was washed with three, 5 ml portions of n-heptane. The filter paper disk was removed and compared visually with those on the Potential Deposit Code.

The results of the Potential Deposit Test are shown below in Table III.

TABLE III

| The Potential Deposit Test | | | |
|---|---|---|---|
| Run | Fuel | Additive at Concentration, wt. % | Test Rating(1) |
| 1 | Base | No additive | 4+ |
| 2 | Base | Example I 0.0095 wt. % (25 PTB) | 2 |
| 3 | Base | Example II 0.0095 wt. % (25 PTB) | 3 |
| 4 | Base | Example III 0.0095 wt. % (25 PTB) | 5 |

(1)0 good 4+ bad
(2)Reaction product of Jeffamine M-600, maleic anhydride and Duomeen O
(3)Reaction product of Jeffamine M-300, maleic anhydride and Duomeen-T
(4)Reaction product of Jeffamine M-1000, maleic anhydride and Duomeen-T As shown by the data in Table III, above Example 1 was effective in stabilizing the fuel against sediment formation. Comparative Examples II and III were not effective in stabilizing the fuel composition against sediment formation.

It is understood that this invention is not to be limited to the specific examples herein presented. The scope of the invention is to be determined by the appended.

What is claimed is:

1. A middle distillate fuel oil composition characterized by improved storage stability which comprises a major portion of a middle distillate fuel oil; and a minor portion of a storage stabilizing additive prepared by reacting (i) one mole of a hydrocarbon-substituted mono primary ether amine at 100° C. at 2 hours with (ii) one mole of a diabisic acid anhydride to form maleamic acid and (iii) reacting said maleamic acid with one mole of an N-alkyl alkylene diamine at 100° C. for 2 hours to produce said storage stabilizing additive.

2. The middle distillate fuel oil composition of claim 1, wherein said ether amine is a primary amine $$R'(OCH_2CH_2)_x(OCH_2\overset{\overset{CH_3}{|}}{C}H)_y-NH_2$$

wherein x is 1, R' is a hydrocarbon group selected from the group consisting of an alkyl, alkaryl, aralkyl, aryl or a cycloalkyl and y is an integer of about 8 to about 9.

3. The middle distillate fuel oil composition of claim 1, wherein said primary ether amine is $$C_{10}C_{12}-(OCH_2-\underset{\underset{CH_3}{|}}{C}H)_2-NH_2$$

4. The middle distillate fuel oil composition of claim 1, wherein said primary ether amine is $$nC_4H_9\text{-}\!\!\!